United States Patent [19]

Brackett

[11] Patent Number: 4,884,582

[45] Date of Patent: Dec. 5, 1989

[54] CIGARETTE MOISTENING APPARATUS AND COMPONENTS THEREOF

[76] Inventor: George E. Brackett, 9897 Treasure Cay Ln., Bonita Springs, Fla. 33923

[21] Appl. No.: 940,063

[22] Filed: Dec. 10, 1986

[51] Int. Cl.[4] ..... A24F 47/00

[52] U.S. Cl. ..... 131/329; 131/329; 131/173; 131/335

[58] Field of Search ..... 131/300, 329, 173, 335

[56] References Cited

U.S. PATENT DOCUMENTS 2,895,651 2/1956 Mahon et al. .
2,913,154 11/1959 Kuffer .
3,232,493 2/1966 Beard, Jr. .
3,319,632 5/1967 Burbig .
4,233,995 11/1980 Kotuby .

*Primary Examiner*—V. Millin
*Attorney, Agent, or Firm*—Lerner, David, Littenberg, Krumholz & Mentlik

[57] ABSTRACT

Apparatus for moistening a cigarette, particularly a filter tip cigarette, prior to smoking. The apparatus preferably includes a button mounted on the stem of an aerosol cartridge. The button has a cigarette-receiving bore arranged so that a cigarette received in the bore extends transverse to the axis of the cartridge. The button may also have a nozzle recessed in an end wall of the bore so that liquid discharged through the nozzle spreads transverse to the axis of the cigarette in a chamber defined by the end of the filter and the end wall of the bore. The button desirably is arranged to engage the stem of a stem-actuated aerosol cartridge or similar dispenser to mount the button on the dispenser and to hold the button in the desired orientation relative to the dispenser. In an alternative arrangement, the button has a hollow needle disposed within the cigarette-receiving bore and arranged to impale a cigarette engaged in the bore. The interior of the hollow needle is connected to the aerosol cartridge.

19 Claims, 1 Drawing Sheet

CIGARETTE MOISTENING APPARATUS AND COMPONENTS THEREOF

BACKGROUND OF THE INVENTION

The present invention relates to cigarette moistening devices and components thereof.

It has long been recognized that the deleterious effects of cigarette smoking may be mitigated at least to some degree by moistening the cigarette, and particularly the end of the cigarette proximate to the smoker. Thus, in a filter cigarette, the filter itself can be moistened. The moistened cigarette end or filter tends to absorb harmful constituents from the tobacco smoke.

It is generally not practical to pre-moisten cigarettes prior to distribution and sale. Accordingly, various devices have been proposed heretofore for use by the individual smoker in moisturizing either the entire cigarette or the filter alone. Burbig, U.S. Pat. No. 3,319,632, discloses a moisturizer in the form of a generally cylindrical squeeze bottle. The bottle is provided with a cylindrical receptacle for receiving the filter end of a cigarette, and holding the cigarette so that the cigarette is generally coaxial with the container. A needle mounted within the cylindrical receptacle impales the cigarette filter, so that fluid dispensed from within the bottle, as by squeezing, will be forced into the filter and moisturize the same. Kotuby et al., U.S. Pat. No. 4,233,995, discloses a rather complex device including an elongated cylindrical cigarette receiving receptacle, an elongated needle disposed within that receptacle and an external housing surrounding the receptacle. The external housing has various components adapted to hold a small, generally cylindrical aerosol dispenser unit having a hollow actuator stem so that the axis of the dispenser unit extends generally parallel to the axis of the cigarette receiving receptacle. Other components are provided for connecting the hollow stem of the aerosol dispenser with the needle. In use, a cigarette is impaled on the needle and the aerosol dispenser is actuated by moving the aerosol dispenser relative to the external housing. Fluid from the dispenser flows through the hollow stem of the dispenser and through the needle into the cigarette.

These and other devices developed heretofore for moistening cigarettes have not been widely accepted in the marketplace because they have not been particularly convenient to carry and/or use. Typically, these devices have been ill suited to one-handed operation, and hence have been ill suited to use in situations where one hand is required for other activities, as, for example, while driving an automobile or the like. Moreover, many of the moistening devices proposed heretofore have been rather bulky and cumbersome. Also, many of the devices proposed heretofore have been relatively expensive and hence have been unsuitable for sale as disposable items.

SUMMARY OF THE INVENTION

One aspect of the present invention provides a cigarette moistening device which substantially overcomes these drawbacks. A moistening device according to this aspect of the present invention preferably utilizes a small, stem-actuated dispenser, such as a pressure-charged aerosol type dispenser or a pump type dispenser. Dispensers of both types are widely utilized in many different applications, as, for example, in connection with medications, cosmetics and the like. Both types of dispenser include a container, a hollow stem projecting from the container in a stem direction, liquid disposed within the container, and discharge means, also mounted within the container, for discharging the liquid through the hollow stem upon movement of the stem relative to the container. In preferred moistening apparatus, according to the present invention, the container is small enough to be held in the palm of a normal human hand.

Apparatus according to this aspect of the present invention also preferably includes a button mounted on the stem, the button having a button body defining a cigarette-receiving bore extending in a bore direction, the bore having an open end and being adapted to receive the end of a cigarette so that the cigarette also extends in the bore direction. The bore communicates with the hollow stem. When the end of a cigarette is engaged in the bore, the axis of the cigarette extends substantially in the bore direction. Most preferably, according to the present invention, the bore direction is transverse to the stem direction. Typically, the container is elongated, and the stem protrudes from one end of the container, so that the stem direction corresponds to the direction of elongation of the container. Thus, the cigarette, while engaged in the bore of the button, will extend generally transversely to the axis of the container. It is accordingly easy to hold the device, with the cigarette engaged, in one hand, as by grasping the container between the palm and the fingers of the hand, and actuate the device, as by pushing on the button with the thumb of the same hand. Upon actuation liquid discharged from the container enters the bore and moistens the end of the cigarette.

The liquid utilized as the moistening fluid may be any liquid which, when added to the cigarette, will provide the desired effect of absorbing the deleterious constituents of the tobacco smoke but which does not add any undesired substances to the cigarette. Aqueous liquids are preferred, and plain water can be employed. Also, aqueous solutions of flavorants and other constituents useful in conjunction with a cigarette can be used.

The button may incorporate one or more needles disposed within the cigarette-receiving bore of the button body so that the cigarette will be impaled on the needles when inserted into the bore, and the needles may be arranged in communication with the hollow stem of the dispenser, so that the moistening fluid is injected into the filter of the cigarette via the needle or needles.

More preferably, however, these needles are omitted. According to a further aspect of the invention, the button is provided with a nozzle opening through the end wall of the bore remote from the open end. The button most preferably is also provided with a stop in the bore for holding the end of the cigarette at a predetermine distance away from the nozzle, so that the cigarette and the walls of the bore cooperatively define a chamber between the nozzle and the end of the cigarette. Particularly with a filter-tip cigarette, this arrangement provides satisfactory transfer of the moistening liquid into the cigarette, and into the end of the filter, without the need for needles and the accompanying complexity and cost. In the chamber defined between the end of the cigarette and the end wall of the bore, the liquid discharged through the nozzle spreads outwardly, in the directions transverse to the axis of the bore and transverse to the axis of the cigarette. This is particularly advantageous, because the fibers in a typical cigarette filter extend axially. The filter conducts moisture rapidly in the axial direction, but conducts less well in the directions transverse to the axis.

A moistening device according to preferred aspects of the present invention incorporates only the container, the button, and, if desired, an overcap or other form of shielding to cover the button while the device is not in use. Therefore, the device according to this preferred aspect of the present invention can be made on standard equipment used for filling and capping dispensing containers for many different purposes. Thus, the container itself may be filled with the desired moistening fluid in precisely the same way as the container might be filled with fluid for another purpose. The only other operation required is mounting the button on the stem of the container. This operation also can be performed with standard equipment, as the button is mounted to the stem in precisely the same fashion as an actuator button is applied to a typical dispensing container. The button may have substantially the same dimensions as an actuator button typically used on a dispensing container which further facilitates application of the button to the container by standard equipment and techniques, and also facilitates use of a standard overcap or outer package.

Further aspects of the present invention provide buttons which can be used in conjunction with a standard dispensing container to make a cigarette moistening apparatus, simply by mounting the button on the stem of the container using standard techniques as aforementioned. Preferably, the button itself can be fabricated using standard plastics injection-molding techniques and the like as commonly employed to fabricate typical actuator buttons. Most preferably, the exterior size and shape of an actuator button according to this aspect of the present invention is substantially similar to the exterior size and shape of a conventional actuator button. Thus, many of the same tooling components used to mold a standard actuator button can be used in production of a button according to the invention and, as noted above, standard machinery can be employed in mounting the button on the container.

The button and the entire cigarette moistening device according to preferred aspects of the invention can be made with little initial investment and with the well-developed, economical production techniques used for filling and capping common dispensing containers. These aspects of the present invention provide a cigarette moistening device which is not only convenient to use, but also so inexpensive that the same constitutes a disposable item.

Other aspects, features and advantages of the present invention will be more readily apparent from the detailed description of the preferred embodiment set forth below, taken in conjunction with the accompanying drawings.

DETAILED DESCRIPTION OF THE PREFERRED EMBODIMENTS

Figure 1:
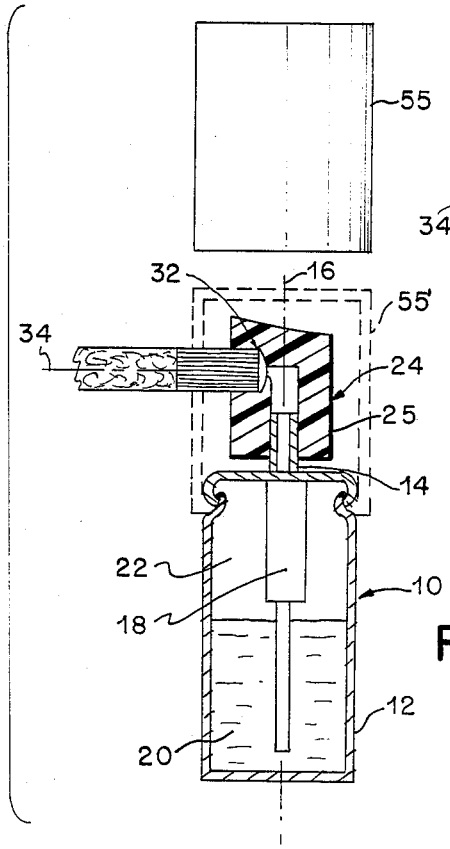
FIG. 1 is a schematic sectional view of a cigarette moistening apparatus according to one embodiment of the present invention.

Apparatus according to one embodiment of the present invention includes a stem actuated dispenser 10 comprising a generally cylindrical container body 12 approximately 1 inch in diameter and approximately 2½ inches long. The dispenser also includes a hollow tubular stem 14 which is movably mounted to container 12. The axis of the stem is parallel to, and coincident with, the axis 16 of cylindrical container 12. Stem 14 is movable over a limited range relative to container 12, in directions parallel to container axis 16, between a rest position and a displaced position. A suitable cigarette moistening liquid 2 is disposed within container 12, and the dispenser is provided with a discharge device 18 for discharging the liquid 20 through hollow stem 14 when the stem is moved to its displaced position. Discharge device 18 includes a conventional valve, and the discharge is assisted by pressurized, vaporizable propellant 22, also disposed within the container. However, the discharge device 18 may also be a conventional pump type device, in which case the propellant 22 is not required. The stem actuated dispenser per se is conventional, and accordingly need not be described in further detail herein. As well known to those skilled in the packaging art, such dispensers can be fabricated, filled and closed using conventional, widely available high-speed equipment.

The moistening device also includes a button 24 which is mounted on stem 14. Button 24 has a body 25 which is generally cylindrical in shape; cylindrical button body 25 defines a stem bore 26 coincident with its axis. Stem bore 26 is provided with a shoulder 28 which abuts the end of stem 14 when the stem is received in stem bore 26 through the open end 30 of the stem bore. Those portions of stem bore 26 adjacent open end 30 are dimensioned to provide a press fit with the exterior of stem 14 and hence, in conjunction with shoulder 28, provide means for mounting the button on the stem. Because the axis of the stem bore is substantially coincident with the axis defined by the cylindrical button body 25, the axis of the button body is substantially coincident with the axis of the stem 14 and hence coincident with the axis 16 of container 12 (FIG. 1) as well when the button is mounted on the stem.

Button body 25 also defines a cigarette-receiving bore 32 having a bore axis 34 substantially transverse to axis of stem bore 26. Thus, when button 24 is mounted on stem 14, cigarette-receiving bore axis 34 extends transverse to the axis of stem 14 and transverse to container axis 16. Cigarette-receiving bore 32 has an open end 36, a peripheral wall 38 extending around bore axis 34 and an end wall 40 extending across the bore remote from open end 36, thereby defining a substantially closed end. End wall 40 is concave towards open end 36, i.e., the wall slopes towards open end 36 adjacent peripheral wall 38. In the embodiment illustrated, the end wall 40 has generally spherical curvature. End wall 40 has peripheral portions 42 relatively close to open end 36 and a central portion 44 relatively far from open end 36. A nozzle hole 46 extends through central portion 44 of end wall 40, so that the end wall defines a nozzle facing towards open end 36 of bore 32. As nozzle hole 46 communicates with the interior of stem bore 26, the interior of bore 32 is placed in communication with the interior of hollow stem 14 by way of nozzle hole 46 and stem bore 26 when the button is mounted on stem 14.

Figure 3:
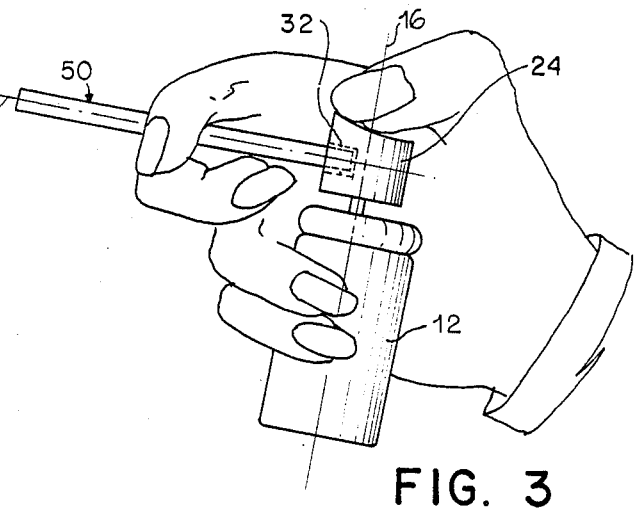
FIG. 3 is a schematic elevational view depicting the apparatus of FIGS. 1 and 2 in use.
Figure 2:
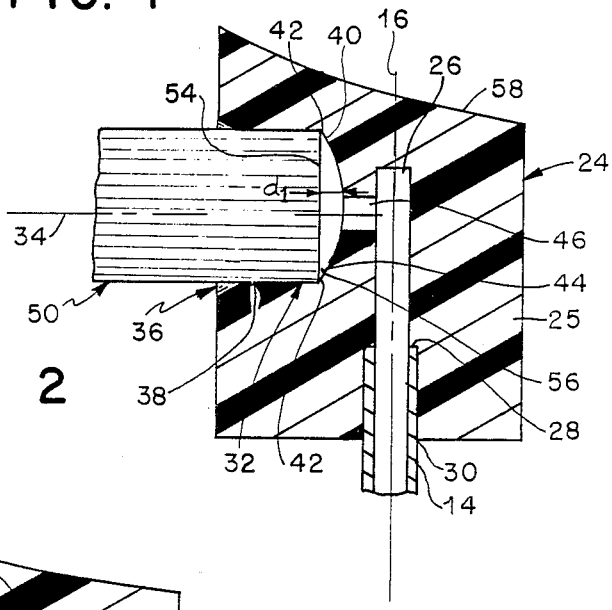
FIG. 2 is a fragmentary, schematic sectional view on an enlarged scale depicting a portion of the apparatus shown in FIG. 1.

As seen in FIGS. 1–3, cigarette-receiving bore 32 is adapted to receive the filter tip end of a common filter cigarette 50 so that the cigarette extends generally along bore axis 34. Thus, bore 32 is approximately 5/16 of an inch in diameter, so that peripheral wall 38 provides a light press fit with the exterior surface of the cigarette filter tip. As best seen in FIG. 2, the end surface 54 of the cigarette filter tip inserted into bore 32 abuts the peripheral portions 42 of bore end wall 40. The peripheral portions of the bore end wall thus serve as a stop, and retain the end surface 54 of the cigarette filter tip at a predetermined distance $d_1$ away from the central portion 44 of bore end wall 40 and at the same predetermined distance away from nozzle 46, so that the cigarette end surface and the concave bore end wall surface cooperatively define a chamber 56. This distance preferably is between about ⅛ and about ⅜ in. and more preferably between about ¼ and about ⅜ in.

An overcap 55 is provided for covering button 24 when the device is not in use, as indicated at 55' in FIG. 1. The overcap is arranged to provide a frictional fit with the exterior of container 12. When the device is in use, overcap 55 is removed. In use, when the button is actuated, the liquid 20 (FIG. 1) is discharged through the hollow stem 14, through stem bore 26 and through nozzle opening 46, into bore 32 and into the chamber 56 defined at the inward end of the bore by the cigarette itself by the cigarette filter and the end wall 40. The space within chamber 56 aids in distributing the moistening fluid transversely of bore axis 34 and hence aids in moistening the filter substantially across its width.

The moistening device, and the cigarette engaged therewith, can be held conveniently and actuated by one hand. Thus, the cigarette can be graphed between the first and second fingers, the container 12 can be held between the pinky and ring fingers and the palm, and button 24 can be engaged by the thumb of the same hand, all as shown in FIG. 3. As will be appreciated from FIG. 3, this particularly convenient mode of operation is greatly facilitated by the orientation of bore axis 34, and hence cigarette 50, transverse to container axis 16. In particularly preferred embodiments, the bore axis can intersect the axis of stem bore 26 (FIG. 2) and hence the container axis 16 either at an angle of exactly 90°, as illustrated, or else at an angle of about 45° to about 90°, intersection angles between about 75° and about 90° being more preferred. To facilitate holding the device and also to facilitate storage as in a pocket or purse, the container should preferably be less than about 1½ in. in diameter, and most preferably between about 1 and about 1¼ in. in diameter. As illustrated, the container 12 is substantially in the form of a circular cylinder. However, other elongated forms of container, such as a rectangular solid, or a cylinder having as its base an elipse or other like figure can be employed. With respect to elongated containers other than cylinders, the largest dimension transverse to the axis of elongation should be considered as the diameter. Most preferably, the diameter or greatest dimension of the button 24 transverse to the container axis 16 and hence the greatest dimension of the button transverse to the axis of stem bore 26 should be slightly less than the diameter of container 12. Thus, the button 24 may preferably have a diameter between about ⅜ and about 1 in. and more preferably between about ½ and about ¾ in. Also, the button may be provided on its top surface 58 with an indentation, knurling or the like to facilitate engagement by the thumb. The length of the entire device, from the top surface of button 24 to the bottom end of container 12, is desirably less than about 4 in. and more preferably between about 3¼ in. and about 3½ in.

The nozzle hole or orifice 46 preferably is 0.005 in. to 0.050 in. in diameter, most preferably about 0.010 in. in diameter. The nozzle hole or orifice typically is about 0.025 in. to about 0.125 in. long, most preferably about 0.050 in. long. Desirably, the nozzle dimensions are matched with the characteristics of dispenser 10 so that between about 0.05 cc and about 0.5 cc of liquid, and most preferably about 0.20 cc of liquid are discharged through the orifice on each actuation. The most preferred orifice dimensions noted above about the optimum delivery for an aerosol-type dispenser holding an aqueous fluid under about 100 PSIG pressure.

As will be appreciated from the foregoing description, the process of making the moistening device as above involves merely filling the standard stem actuated dispenser with an appropriate moistening liquid, then placing button 24 onto the stem 14 of the dispenser and, optionally, adding overcap 55. Inasmuch as the button conforms generally to the sizes and shapes of common buttons ordinarily used for other applications with spray actuated dispensers, these operations can be performed by substantially the same equipment as employed in making ordinary packages using stem actuated dispensers.

Figure 4:
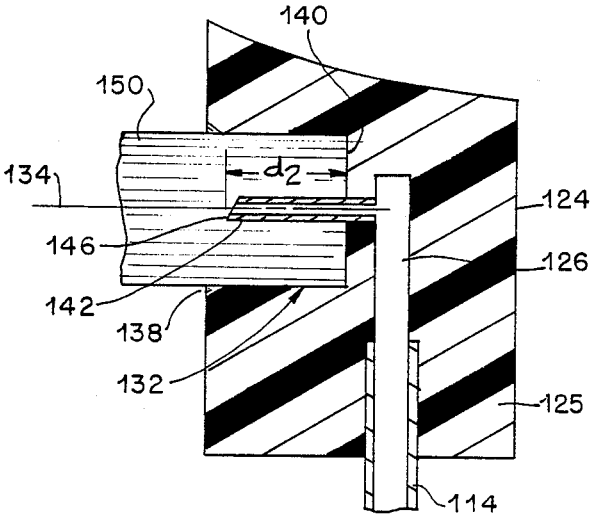
FIG. 4 is a view similar to FIG. 2 but depicting a portion of apparatus according to a further embodiment of the present invention.

A moistening device according to a further embodiment of the present invention is illustrated in FIG. 4. This device includes a button 124 generally similar to the button described above with reference to FIGS. 1–3 and having a generally similar stem bore 126 for receiving the stem 114 of a dispenser. Button 124 also has a cigarette-receiving bore 132, the axis 134 of the cigarette-receiving bore extending generally perpendicular to the axis of stem bore 126. However, the end wall 140 of bore 132 is substantially flat. A hollow metallic needle 142 extends through end wall 140 substantially on bore axis 134 and hence coaxially with bore 132, needle 142 being attached to the body 125 of button 124. The interior of bore 132 communicates with the interior of stem 114 by way of needle 142. Needle 142 protrudes beyond end wall 140 a predetermined distance towards the open end 138 of bore 132. There is a point 146 at the distal end of the needle 142, adjacent open end 138, so that a cigarette will be impaled on needle 142. End wall 140 acts as a stop to control insertion of the cigarette into bore 132. As needle 142 extends only a predetermined distance $d_2$ from end wall or stop 140 into bore 132, towards the open end, the needle will only extend into the cigarette by the same predetermined distance when the cigarette is bottomed against the stop. To assure that the point of the needle lodges within the filter, and not within the tobacco component of an ordinary filter cigarette, this predetermined distance desirably is between about ¼ and about ⅜ in. The operation of the device as illustrated in FIG. 4 is substantially the same as that illustrated in FIGS. 1–3. Thus, when the cigarette is inserted into the cigarette-receiving bore 132 and the dispenser associated with button 124 is actuated by pressing on the button to move stem 114, the moistening liquid is discharged through stem 114, stem bore 126 and the interior of needle 142, and hence is introduced into the filter of the cigarette.

The buttons described above can be fabricated using substantially the same techniques as employed for fabrication of common actuator buttons ordinarily employed on stem actuated dispensing packages. Thus, a button as illustrated in FIG. 2 may be fabricated entirely in a single injection molding operation, whereas a button as illustrated in FIG. 4 may be fabricated by a similar injection molding operation followed by insertion of needle 142, as by gluing, ultrasonic insertion or the like. Alternatively, a button as illustrated in FIG. 4 can be fabricated by a process of insert molding, wherein the needle 142 is present in the mold during the injection molding cycle.

As will be readily appreciated, numerous variations and combinations of the features described above can be utilized without departing from the present invention as defined in the claims. Merely by way of example, the word "cigarette" has been utilized as describing the product treated by the present device. However, other tobacco products, such as substantially cylindrical items commonly referred to as "cigarillos" or as small cigars can be treated substantially in the same way. Accordingly, the term "cigarette" as utilized in this disclosure should be understood as compassing these products as well, unless otherwise specifically indicated. Also, although it is greatly preferred to moisten the filter of a filter tip cigarette as described above, substantially the same technique can be employed in moistening a non-filtered cigarette, if desired.

In the embodiments discussed above, the cigarette-receiving bore of the button extends transverse to the stem of the dispenser, and thus extends transverse to the axis of the container which holds the liquid. This arrangement is particularly advantageous where the apparatus is to be hand-held. The same arrangement can be used in apparatus for table top use, as where the liquid container is provided with a base for resting on a table. Other arrangements can also be used in table-top apparatus. Thus, in a table-top moisturizing apparatus, the cigarette-receiving bore may extend parallel to the stem bore.

As these and other variations and combinations of the above-described features can be employed, the foregoing description of the preferred embodiments should be taken by way of illustration rather than by way of limitation of the present invention as defined in claims.

What is claimed is:

1. A cigarette moistening apparatus comprising:

(a) a dispenser including a container adapted to be held in the hand, a liquid disposed within said container, said liquid being suitable for moistening a cigarette, said dispenser also having a hollow stem movably mounted to said container and projecting therefrom in a first direction, and means for discharging said fluid through said hollow stem upon movement of said stem relative to said container; and (b) a button mounted on said stem, said button having a cigarette-receiving bore, said bore having a bore axis extending in a bore direction generally transverse to said first direction, said bore having an open end adapted to receive an end of a cigarette so that the cigarette projects lengthwise in said bore direction, said bore communicating with said hollow stem, whereby a cigarette can be moisturized by inserting the same in said bore and engaging said button to thereby move said stem.

2. Apparatus as claimed in claim 1 wherein said container is elongated, the axis of the elongated container extending in said first direction whereby said bore direction is generally transverse to the axis of elongation of said container.

3. Moistening apparatus as claimed in claim 2 wherein said stem is mounted to said container for movement relative thereto in a direction parallel to the axis of said container.

4. Moistening apparatus as claimed in claim 1 wherein said means for discharging includes a pump disposed within said body and actuated by said stem.

5. Moistening apparatus as claimed in claim 1 wherein said means for discharging includes a vaporizable propellant disposed within said body and a valve linked to said stem for actuation thereby.

6. Moistening apparatus as claimed in claim 1 wherein said liquid is an aqueous liquid.

7. Moistening apparatus as claimed in claim 1 wherein said button has a hollow tubular needle projecting in said bore direction within said bore, whereby a cigarette engaged within said bore will be impaled by said needle, said needle communicating with said stem whereby fluid discharged through said stem will be introduced into said cigarette via said needle.

8. Moistening apparatus as claimed in claim 1 wherein said button has a nozzle disposed within said cigarette-receiving bore remote from said open end and facing towards said open end and a stop disposed within said bore between said nozzle and said open end so that a cigarette inserted into said bore will be arrested by said stop and will be remote from said nozzle, said bore communicating with said hollow stem by way of said nozzle so that fluid dispensed into said bore will be projected through said nozzle toward the end of a cigarette engaged in said bore.

9. Moistening apparatus as claimed in claim 8 wherein said button has a bore end wall extending transversely across said cigarette-receiving bore and surrounding said nozzle, said bore end wall sloping from said nozzle towards said open end of said bore, said stop including portions of said bore end wall adjacent to the periphery of said bore, whereby the end of a cigarette inserted into said bore and said bore end wall will cooperatively define a chamber, and fluid discharged through said nozzle will be introduced into said chamber.

10. A button for mounting on the hollow stem of a stem-actuable dispenser, said button having a body defining a cigarette-receiving bore adapted to receive the end of a cigarette, said bore having a bore axis, an open end, a peripheral wall and an end wall extending transversely across said bore remote from said open end, said end wall having a nozzle opening extending therethrough, said button also having stop means for holding a cigarette received in said bore remote from said nozzle opening and at a predetermined distance from said nozzle opening, and dispenser engaging means for engaging a liquid dispenser so that said nozzle communicates with said dispenser to receive liquid discharged therefrom.

11. A button as claimed in claim 10 wherein said end wall has a central portion remote from said peripheral wall and a peripheral portion adjoining said peripheral wall, said nozzle opening extending through said central portion, said stop means including said peripheral portion.

12. A button as claimed in claim 11 wherein said dispenser-engaging means includes means for engaging a stem of a stem-actuated dispenser so that said nozzle opening communicates with said stem and so that said bore axis extends generally transversely of said stem.

13. A button as claimed in claim 11 wherein said peripheral portion of said end wall is disposed between about $\frac{1}{8}$ in. and about $\frac{3}{8}$ in. closer to said open end of said bore than said central portion.

14. A button as claimed in claim 10 wherein said predetermined distance is between about $\frac{1}{8}$ in. and about $\frac{3}{8}$ in.

15. Apparatus for moistening a cigarette comprising a button as claimed in claim 10 and a dispenser engaged by said dispenser-engaging means, said dispenser including a container, a liquid disposed in said container, said liquid being suitable for moistening a cigarette, said dispenser also having means for discharging said liquid.

16. A button for engagement with a stem-actuated dispenser, said button having a button body, a hollow needle mounted to said button body, and means for engaging the button body with a hollow, tubular stem of a stem-actuated dispenser so that the interior of the stem of the dispenser communicates with the interior of said hollow needle and so that said hollow needle extends generally transversely of the stem of the dispenser, said button body defining a cigarette-receiving bore having a bore axis and an open end, said bore being adapted to receive a cigarette so that the axis of the cigarette is substantially aligned with said bore axis, said needle being disposed within said bore so that the needle will impale a cigarette engaged in said bore.

17. A button as claimed in claim 16 wherein the entirety of said needle is disposed within said bore.

18. A button as claimed in claim 16 further comprising a stop disposed within said bore and projecting into said bore at a predetermined location remote from said open end of said bore, said needle projecting beyond said stop toward said open end of said bore by a predetermined impaling distance, whereby said needle will impale the end of a cigarette engaged in said bore only to a depth equal to said predetermined impaling distance.

19. A button as claimed in claim 16 wherein said predetermined impaling distance is between $\frac{1}{4}$ in. and $\frac{3}{8}$ in.

* * * * *